US009265336B2

(12) United States Patent
Park

(10) Patent No.: US 9,265,336 B2
(45) Date of Patent: Feb. 23, 2016

(54) ROTATABLE ROLL BRUSH

(71) Applicant: TURBO ION, INC., Buena Park, CA (US)

(72) Inventor: Tae Jong Park, Buena Park, CA (US)

(73) Assignee: TURBO ION, INC., Buena Park, CA (US)

( * ) Notice: Subject to any disclaimer, the term of this patent is extended or adjusted under 35 U.S.C. 154(b) by 0 days.

(21) Appl. No.: 14/292,624

(22) Filed: May 30, 2014

(65) Prior Publication Data

US 2015/0342333 A1 Dec. 3, 2015

(51) Int. Cl.
*A46B 7/10* (2006.01)

(52) U.S. Cl.
CPC ..... *A46B 7/10* (2013.01)

(58) Field of Classification Search
CPC ..... A46B 7/10; A46B 13/08
See application file for complete search history.

(56) References Cited

U.S. PATENT DOCUMENTS 4,329,567 A * 5/1982 Kunz et al. ..... 219/222

FOREIGN PATENT DOCUMENTS

GB 2077098 A * 12/1981

* cited by examiner

*Primary Examiner* — Shay Karls
(74) *Attorney, Agent, or Firm* — Benjamin Diederich; Gresham Savage Nolan & Tilden, PC

(57) ABSTRACT

A rotatable roll brush that despite combing tangled hair, the hair does not get removed due to the rotation of the brush body part, and when a combing action is required without the rotation of the body part, the brush can be converted and used as a regular brush.

5 Claims, 6 Drawing Sheets

ROTATABLE ROLL BRUSH

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical field

The present invention is in regards to a rotatable roll brush and, more specifically, to a rotatable roll brush that, despite combing tangled hair, the hair does not get removed due to the rotation of the brush, and further that the brush can be converted to use as a regular brush such that a combing action may be performed without rotation of the brush.

2. Background Technology of the Invention

Generally, hairbrushes are used to comb or roll hair when styling the hair. A regular hairbrush, as shown in FIG. 7, has a handle part (4), which is extended for easy combing. Formed on the handle part (4) is a bristle body part (6). In addition, formed on the bristle body part (6), is a brush hair part (8), which is made up of bristles for combing hair. A hairbrush can comb hair or allow easy rolling of hair when drying or straight perming hair with a drier or a hair perm machine. However, conventional hairbrushes, which have the handle part (4) and bristle body part (6) integrated in a single body, are inconvenient in that when rolled hair is to be unrolled, the handle part (4) of the hair brush must be rotated manually in order to unroll.

In order to overcome these deficiencies, hair driers with a built-in drive system for rotating a hair brush have been developed. However, these not only have high production costs due to being automatically rotated by a driving system but also have problems in that they stop operating when hair is caught.

BRIEF SUMMARY

Accordingly, the brush described in the present disclosure has been devised to resolve problems such as the abovementioned problem. Described herein is a rotatable roll brush in which locking protrusions rotate while being fastened to an elastic locking piece so that even when combing tangled hair, it does not pull the hair since the brush body part rotates.

In addition, the rotatable roll brush prevents damage to the elastic locking piece and the like after prolonged use and maintains its elasticity by arranging the locking protrusions and elastic locking piece in the same rotating direction.

In addition, the rotatable roll brush can be used as a regular brush without rotation of the brush body part by pressing a stopping button when combing.

In addition, the rotatable roll brush may be formed such that when rotating and combing, the hair does not get caught on the rotating groove as much as possible by including a skirt member on the front end part of the handle part.

To achieve the abovementioned purposes, the rotatable roll brush of the present disclosure may comprise a brush body part where a plurality of comb teeth are arranged on the outer circumferential surface; a handle part whose front end part is open, interior is clear, and on whose inner circumferential surface is an elastic locking piece installed along the circumference; and a rotating body part whose front end part joins the brush body part, back end part joins the handle part to allow rotation, and on the outer circumferential surface of the back end part are a plurality of locking protrusions formed such that the elastic locking piece is inserted to control the rotation.

In addition, the elastic locking piece in the rotating roll brush may comprise a pair of fastening members fastened to the handle part; a protruding member interlocking with the groove formed between two of the locking protrusions; and an extending member connecting the fastening member and the locking protrusions.

In addition, the rotatable roll brush may have a stopper groove formed on the outer circumferential surface of its rotating body part, and a stopper button formed on the handle part, inserted into the stopper groove, to prevent the rotating body part from rotating.

In addition, a rotating groove and an elevated platform adjacent to the rotating groove may be formed on the outer circumferential surface of the rotating body part of the rotatable roll brush, and a rotatable joining piece inserted into the rotating groove and a skirt member joining the elevated platform in order to prevent hair from getting caught on the rotating groove, on the front end part of the handle part.

In addition, the body part of the rotatable roll brush of the present invention may be made of synthetic resin, and on the back end part of the brush body part is a fastening groove that is jagged, and the rotating body part is made of metal to increase drying efficiency by means of high heat conduction when the hair is hot-air dried, and on the inner circumferential surface of the front end part of the rotating body part are locking protrusions, fastened by being inserted by pressure into the fastening groove.

An effect of the rotatable roll brush of the present disclosure, composed as described above, is that the locking protrusions rotate while being fastened to the elastic locking piece, and thereby the brush body part rotates so that even if a combing action is performed while the hair is entangled, the hair is not pulled.

In addition, an effect of the rotatable roll brush of the present disclosure is that by arranging the locking protrusions and the elastic locking piece in the direction of the rotation, it is possible to prevent damages of the elastic locking piece or others and maintain the elasticity despite prolonged use.

In addition, an effect of the rotatable roll brush of the present disclosure is that it can be used as a regular brush through the stopper button for performing a combing action without the rotation of the brush body part.

In addition, an effect of the rotatable roll brush of the present disclosure is that by forming a skirt member on the front end part of the handle part, the hair can be prevented from getting caught on the rotating groove as much as possible when rotating or combing.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
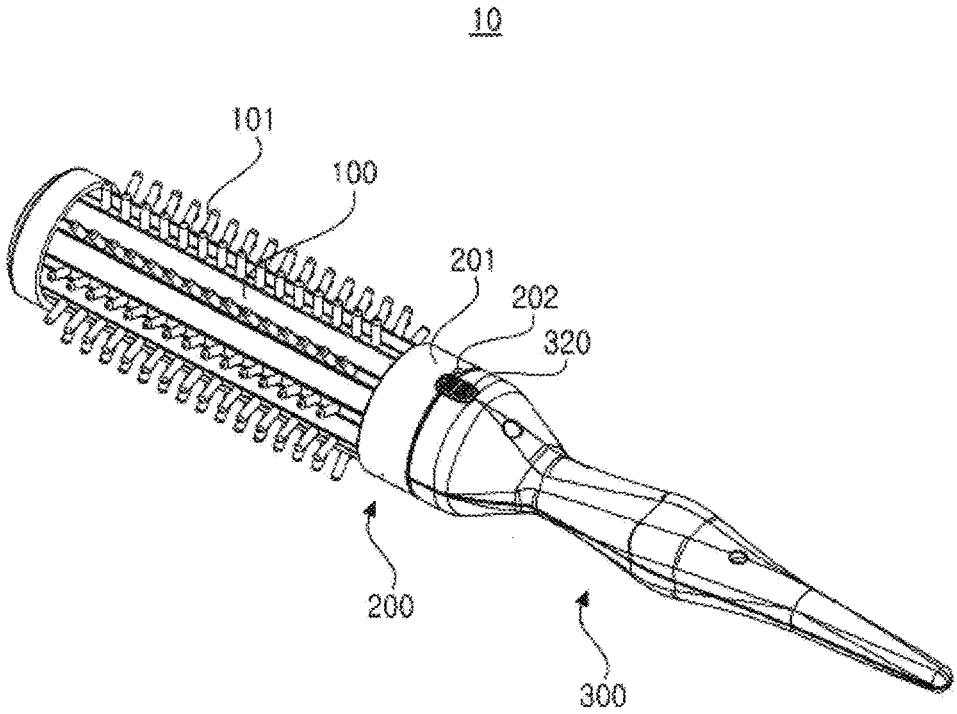
FIG. 1 is a perspective diagram showing an example of implementing the rotatable roll brush.
Figure 2:
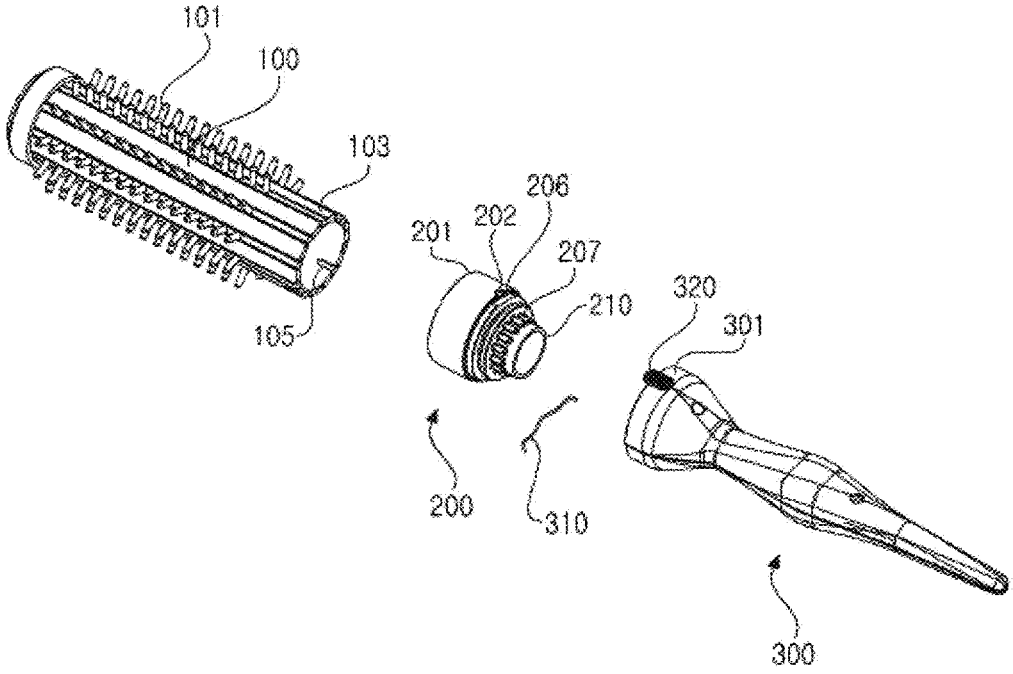
FIG. 2 is a disassembled perspective diagram showing an example of implementing the rotatable roll brush.

Examples of implementing the rotatable hairbrush will be described in greater detail by referencing the attached figures. However, in describing the brush, identical or similar component elements will be given identical or similar figure numbers, and their detailed description will be omitted.

Referring to FIG. 1 through FIG. 4, the rotatable roll brush of the present invention (10) may generally comprise a handle part (300), brush body part (100), and rotating body part (200).

Specifically, the rotatable roll brush of the present invention (10) comprises a brush body part (100) where a plurality of comb teeth (101) are arranged on the outer circumferential surface; a handle part (300) whose front end part (201) is open, interior is empty, and on whose inner circumferential surface is an elastic locking piece (310) installed along the circumference; and a rotating body part (200) whose front end part (201) joins the brush body part (100), back end part (210) joins the handle part (300) to allow rotation, and on the outer circumferential surface of the back end part (210) are a plurality of locking protrusions (207) formed such that the elastic locking piece (310) is inserted to control the rotation.

The brush body part (100) of the present invention may take a shape of cylinder with circular cross-sections, to which it is not necessarily limited, but may take various shapes such as having triangular or rectangular cross-sections.

The brush body part (100) may be made of synthetic resin, but desirably of metal in order to increase the drying efficiency by heat conduction when hair is hot-air dried. For example, it may be made of aluminum, copper, or alloy, having high heat conductivity.

On the back end part (103) of the brush body part (100) is a jagged fastening groove (105). The fastening groove (105) may be jagged toward the front end part. It may be desirable that on the inner circumferential surface of the front end part (201) of the rotating body part (200), are fastening protrusions (203), which are fastened through insertion into the fastening groove (105) by pressure. In particular, when the brush body part (100) and rotating body part (200) are each made of different materials such as aluminum and synthetic resin, respectively, the jagged fastening groove (105) may allow for stronger joining.

The rotating body part (200), being fastened to the brush body part (100), serves to prevent hair from being removed when a force with a magnitude exceeding a set amount is applied and acts on the brush body part (100) while the hair is being combed, because each of the a plurality of locking protrusions (207) rotates through the elastic locking piece (310) depending on the magnitude of the force.

The rotating body part (200) takes on the form of an empty cylinder with an open front end part (201), wherein the front end part (201) surrounds the outer circumferential surface of the back end part (103) of the brush body part (100).

As previously mentioned, on the inner circumferential surface of the front end part (201) is a fastening protrusion (203), which is fastened through insertion into the fastening groove (105) of the above brush body part (100), and thereby the above rotating body part (200) and the brush body part (100) move as one body.

On the outer circumferential surface of the rotating body part (200) is a rotating groove (205) formed in order to join the handle part (300), while allowing rotation, and the rotating groove (205) is joined by a rotatable joining piece (305) of the handle part (300), which will be discussed shortly.

On the back end part (210) of the rotating body part (200) are a plurality of locking protrusions (207), each arranged at regular intervals, which serve to control the rotation of the rotating body part (200).

Between a locking protrusion (207) and a locking protrusion (207) is an elastic locking piece (310) inserted therein, and when a force with a magnitude smaller than the elastic force of the elastic locking piece (310) is acting, the elastic locking piece (310) cannot move, and when a greater force is acting, the elastic locking piece (310) jumps through the locking protrusions (207) to allow the rotation of the rotating body (200).

On the outer circumferential surface of the rotating body part (200), specifically between the front end part (201) and the rotating groove (205), an elevated platform (204) is formed.

The elevated platform (204) is structured to be lower than the outer circumferential surface of the front end part, and is where the skirt member (303) of the handle part (300), which is to be discussed later, is inserted.

The handle part (300) is such that the front end part (301) is opened and empty inside in order to be able to join the rotating body part (200). And on the inner circumferential surface of the front end part (301), a rotatable joining piece (305) is formed to protrude, and the rotatable joining piece (305) is inserted into the rotating groove (205) of the rotating body part (200) such that it is able to rotate.

On the inner circumferential surface of the handle part (300), the elastic locking piece (310) is installed along the circumference. For the elastic locking piece (310) a flat spring that provides elasticity may be used.

And on the inner circumferential surface of the handle part (300), a guiding piece (307) may be formed to allow the rotating body part (200) to rotate stably.

The guiding piece (307) is installed to adjoin the outer circumferential surface of the back end part (210) of the rotating body part (200).

Figure 3:
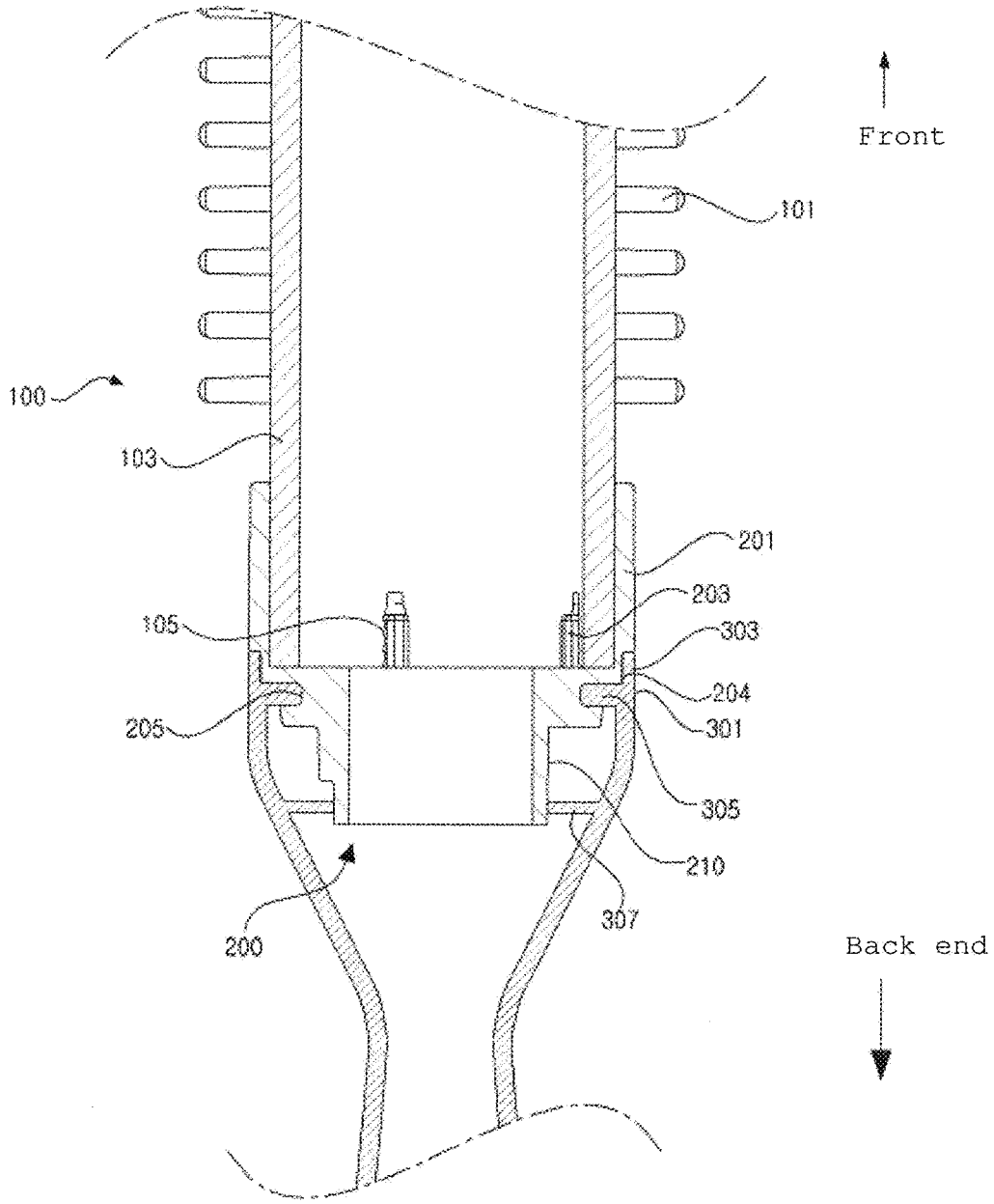
FIG. 3 is a cross-sectional diagram showing an example of implementing the rotatable roll brush.
Figure 4:
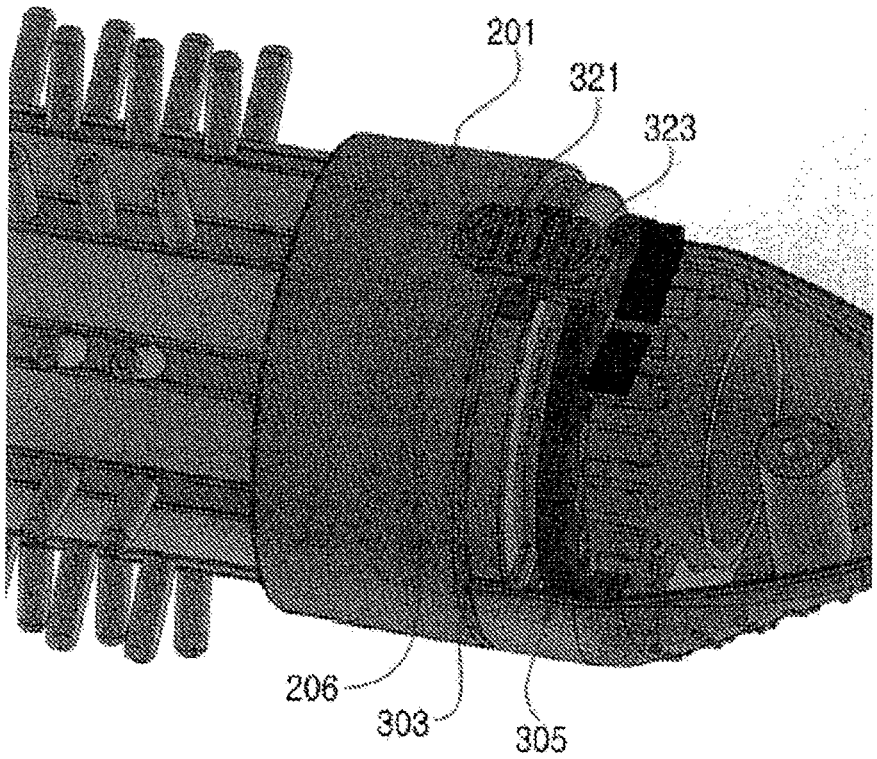
FIG. 4 is a perspective diagram showing a part of an example of implementing the rotatable roll brush.

Meanwhile, referring to FIG. 3 and FIG. 4, it is desirable that a skirt member (303) is formed on the front end part (301) of the handle part (300) in order to prevent hair from getting caught on the rotating groove (205).

And the skirt member (303) may join the elevated platform (204) and be extended from the rotatable joining piece (305) toward the front end part.

In other words, the skirt member (303) is formed to be tiered, thereby preventing hair from getting caught on the rotating groove (205).

If the above skirt member (303) is not formed, the directions of the hair and the rotating groove (205) become the same, and the space between the rotatable joining piece (305) and the rotating groove (205) becomes linear (straight line), thus easy to be exposed to the outside, and thus the hair gets easily dragged into it.

Figure 5:
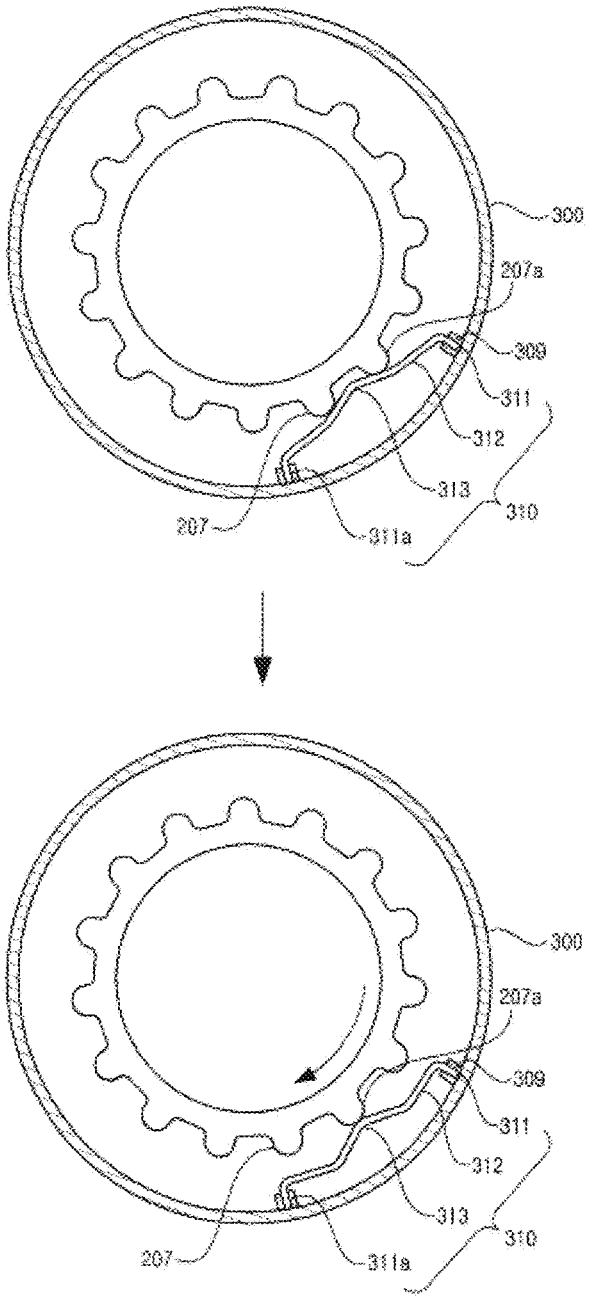
FIG. 5 is a cross-sectional diagram describing the process in which the locking protrusions rotate, fastened with the elastic locking piece, in accordance with the present disclosure.

FIG. 5 is a cross-sectional diagram describing the process in which the locking protrusions rotate, caught on the elastic locking piece, in accordance with the present invention.

Referring to FIG. 5, the rotatable roll brush (10) is such that when a force is applied to the rotating body part (200), the elastic locking piece (310), which is set between the locking protrusions (207) of the rotating body part (200), jumps over the locking protrusions (207) and thereby allows the rotation.

Specifically, the elastic locking piece (310) may comprise a pair of fastening members (311) to be fastened to the handle part (300), a protruding member (312) that interlocks with the groove formed between two of the locking protrusions (207, 207*a*), and an extending member (313) that connects the fastening member (311) and the locking protrusions (207).

Although the present statement suggested a single elastic locking piece, but since the present invention is not necessarily limited to this, multiple elastic locking pieces may be formed.

The fastening member (311) of the elastic locking piece (310) may be inserted into and fastened to the fastening groove (309) formed along the inner circumferential surface of the handle part (300), or maybe be integrated by insert injection molding.

And the pair of fastening members (311) is each fastened to the handle part (300) and thus has great durability and form a stable structure so that even when repeatedly used for a prolong period, it serves to support to maintain the elasticity.

The protruding member (312) of the elastic locking piece (310), when a fixed amount of force is applied, can keep the locking protrusions (207) from rotating, and since it is tapered, can minimize the friction and vibration with the locking protrusions (207).

The extending member (313) of the elastic locking piece (310) allows the protruding member (312) to float by elasticity, and when the protruding member (312) is inserted between locking protrusions (207, 207*a*), applies a pressure to the locking protrusions (207 and 207*a*) to control the rotation.

Accordingly, the rotatable roll brush (10) of the present invention has an advantage that when a smooth combing action cannot be performed on entangled hair, the rotation occurs step by step as the locking protrusions (207) get caught on the elastic locking piece (310).

Figure 6:
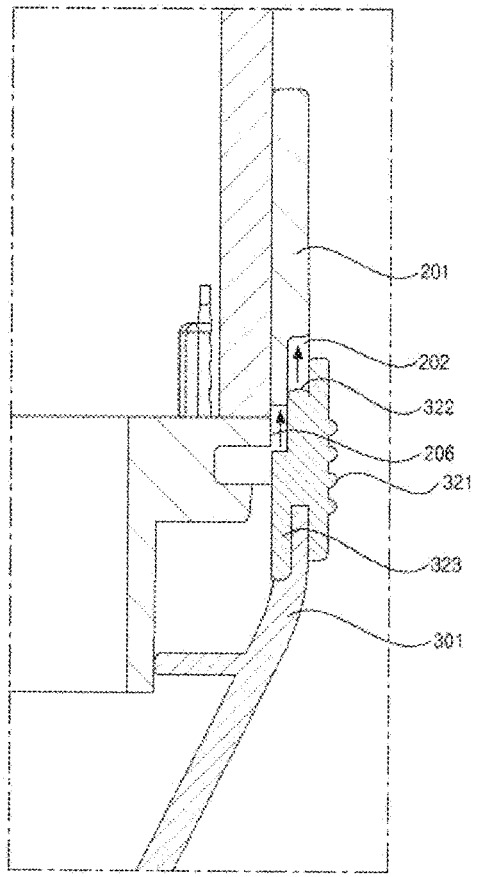
FIG. 6 is a cross-sectional diagram showing the stopper button of the brush.
Figure 7:
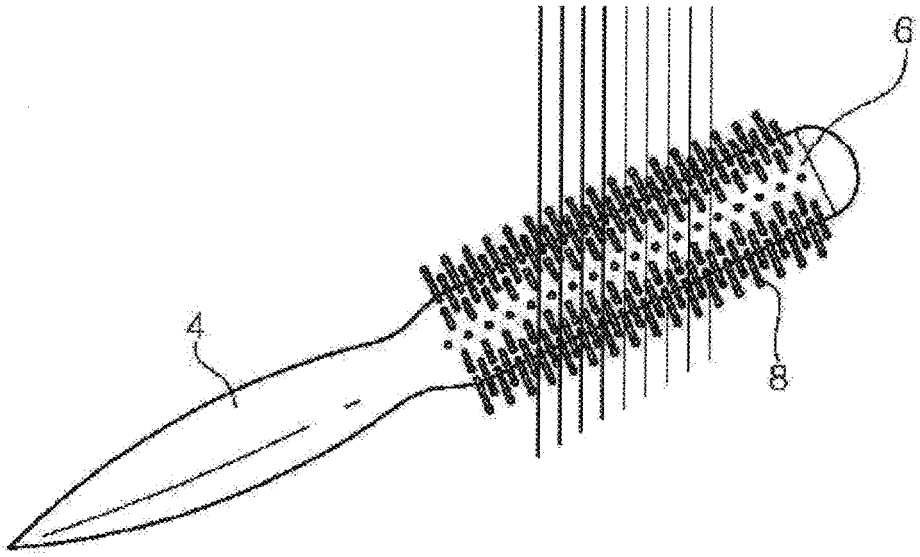
FIG. 7 is a perspective diagram showing a conventional roll brush.

FIG. 6 is a cross-sectional diagram showing the stopper button of the present invention.

Referring to Diagram 6 and Diagram 4 together, the rotatable roll brush (10) of the present invention forms a stopper button (320) to fix the rotating body part (200) and the brush body part (100) and thereby keep them from rotating.

The stopper button (320) largely comprises a button member (321), stopper (322), fastening member (323).

Specifically, the button member (321) is a part that is exposed to the exterior so that the user can selectively control the rotation and fixation of the rotating body part (200) and brush body part (100), and the stopper (322) is a part that is inserted in the stopper groove (202) formed on the outer circumferential surface of the rotating body part (200) to primary fix and keep it from rotating, and the fastening member (323) is a member that fastens the above stopper button (320) to the handle part (300).

In addition, on the rotating body part (200) a flat member (206) may be formed, carved in a flat shape for close contact with the fastening member (323). The fastening member (323), when located on the flat member, suppresses the rotation of the rotating body part and thereby serves to secondarily fix it because the interiors of both fastening member and flat member are flat.

Through the actions of primary fixing by the stopper and secondary fixing by the fastening member, the rotating body part or the brush body part can be fixed more effectively.

Accordingly, the rotatable roll brush (10) of the present invention may be used as a regular brush that does not rotate when a combing action must be performed without the rotation of the brush body part (100) through the stopper button (320).

The description of the present invention so far merely provides examples, and those with general knowledge in the technical field, to which the present invention belongs, must be able to understand that various modifications and other equivalent examples are possible. Therefore, the present invention must well be understood as not being limited to the forms that were described in the above detailed explanation. Accordingly, the true scope of technical protection of the present invention must be determined by the technical ideas of the attached scope of patent claims. In addition, the present invention must be understood as including all modifications, equivalents, and substitutes of ideas of the present invention that are defined by the attached scope of claims.

What is claimed is:

1. A rotatable roll brush comprising:

a brush body part in which a plurality of comb teeth are arranged on an outer circumferential surface thereof;

a handle part in which a front end part is open, an interior thereof is empty, and an elastic locking piece is installed on an inner circumferential surface thereof along the circumference of same; and a rotating body part in which a front end part couples to the brush body part, a back end part couples to the handle part so as to allow rotations, and a plurality of locking protrusions are formed on an outer circumferential surface of the back end part so that the elastic locking piece is inserted to control the rotations;

the elastic locking piece being formed of an elastic material and comprising a protruding member configured to be inserted within a groove formed between two of the locking protrusions such that under normal use the protruding member abuts the locking protrusion and prevents rotation of the rotating body part;

the elastic locking piece further configured so that when sufficient rotational force is applied to the rotating body part, the elastic locking piece elasticity is overcome, thereby disengaging the protruding member from the locking protrusion and allowing rotation of the rotating body part.

2. The rotating roll brush according to claim 1, wherein the elastic locking piece further comprises:

a pair of fastening members fastened to the handle part; and an extending member connecting the fastening member and the locking protrusions.

3. The rotatable roll brush according to claim 1, wherein a stopper groove is formed on the outer circumferential surface of the rotating body part, and a stopper button is formed on the handle part, which is inserted into the stopper groove, so as to prevent the rotating body part from rotating.

4. The rotating roll brush according to claim 1, wherein a rotating groove, which is located on an outer circumferential surface of the rotating body part, and an elevated platform, which is adjacent to the rotating groove, are formed, and a rotatable joining piece, which is inserted into the rotating groove that is at the front end part of the handle part, and skirt member, which is coupled to the elevated platform so as to prevent hair from getting caught on the rotating groove, are formed.

5. The rotating body part according to claim 1, wherein the body part of the rotatable roll brush is formed from a synthetic resin, a jagged fastening groove is formed on a back end part of the brush body part, the rotating body part is formed from metal so as to increase the drying efficiency by means of high heat conductance when the hair is hot-air dried, and fastening protrusions, which are formed on an inner circumferential surface of the front end part of the rotating body part, are fastened by being inserted by means of pressure into the fastening groove.

* * * * *